US012202100B2

(12) United States Patent
Naderer et al.

(10) Patent No.: US 12,202,100 B2
(45) Date of Patent: Jan. 21, 2025

(54) APPARATUS AND METHOD FOR THE AUTOMATIC REMOVAL OF GRINDING DISCS

(71) Applicant: FerRobotics Compliant Robot Technology GmbH, Linz (AT)

(72) Inventors: Ronald Naderer, Linz (AT); Jakob Schinnerl, Linz (AT)

(73) Assignee: FerRobotics Compliant Robot Technology GmbH, Linz (AT)

( * ) Notice: Subject to any disclaimer, the term of this patent is extended or adjusted under 35 U.S.C. 154(b) by 350 days.

(21) Appl. No.: 17/627,362

(22) PCT Filed: Jun. 24, 2020

(86) PCT No.: PCT/EP2020/067693

§ 371 (c)(1),
(2) Date: Jan. 14, 2022

(87) PCT Pub. No.: WO2021/008837

PCT Pub. Date: Jan. 21, 2021

(65) Prior Publication Data

US 2022/0266422 A1 Aug. 25, 2022

(30) Foreign Application Priority Data

Jul. 15, 2019 (DE) ..... 10 2019 119 152.1

(51) Int. Cl.
*B24D 9/08* (2006.01)
*B24B 23/04* (2006.01)
(Continued)

(52) U.S. Cl.
CPC ..... *B24D 9/085* (2013.01); *B24B 23/04* (2013.01); *B24B 27/0038* (2013.01); *B24B 55/102* (2013.01); *B24B 45/006* (2013.01)

(58) Field of Classification Search
CPC ..... B24B 45/006; B24D 9/085; B23Q 3/12; B23Q 3/15513; B23Q 3/15503
(Continued)

(56) References Cited

U.S. PATENT DOCUMENTS 5,231,803 A * 8/1993 Lanzer ..... B24D 9/085 451/28
9,744,635 B2 * 8/2017 Kosonen ..... B23Q 3/15513
(Continued)

FOREIGN PATENT DOCUMENTS

AT 512464 A1 8/2013
EP 2842689 B1 7/2015
WO WO-2017174512 A1 * 10/2017 ..... B24B 27/0038

OTHER PUBLICATIONS

Machine translation of WO-2017174512-A1 (Year: 2017).*

*Primary Examiner* — Robert F Neibaur
(74) *Attorney, Agent, or Firm* — Murphy, Bilak & Homiller, PLLC

(57) ABSTRACT

A device for automatically removing a grinding wheel from a grinding machine mounted on a manipulator is described. According to one embodiment, the device has the following: a support plate with a surface for depositing a grinding wheel; a movable clamping element that is raised in a first position with respect to the support plate; an actuator that is coupled to the clamping element and is configured to move the clamping element into a second position in which the clamping element is pressed against the support plate such that the grinding wheel is clamped between the support plate and clamping element; and a release element that is arranged in such a way relative to the support plate that the release element is actuated when the grinding wheel is placed on the surface of the support plate and is pressed against the latter. The release element and the actuator are coupled (directly or indirectly, electrically or mechanically) such that, when the
(Continued)

release element is actuated, the actuator moves the clamping element from the first position into the second position.

9 Claims, 4 Drawing Sheets

(51) Int. Cl.
*B24B 27/00* (2006.01)
*B24B 45/00* (2006.01)
*B24B 55/10* (2006.01)

(58) Field of Classification Search
USPC ..... 451/5, 259, 496; 29/21
See application file for complete search history.

(56) References Cited

U.S. PATENT DOCUMENTS

2015/0328734 A1* 11/2015 Multhammer ..... B23Q 3/15706
483/33
2016/0039067 A1* 2/2016 Bonnet ..... B24B 23/046
451/259
2019/0001460 A1* 1/2019 Staubli ..... B23Q 3/15526
2019/0009379 A1* 1/2019 Kiuchi ..... H01L 21/67092

* cited by examiner

APPARATUS AND METHOD FOR THE AUTOMATIC REMOVAL OF GRINDING DISCS

TECHNICAL FIELD

The present disclosure relates to a changing station which enables a robot-supported grinding device to automatically change the grinding elements (i.e. grinding discs).

BACKGROUND

Grinding machines are frequently employed in industry and trade. Eccentric grinders are grinding machines in which a rotating movement around a rotational axis is superimposed on an oscillating movement (vibration). They are often used for the final machining of surfaces when high demands are placed on the surface quality, such as for spot repairs of surface defects on painted surfaces. In order to fulfill these demands, irregularities in the grinding process must be avoided as much as possible. In the field this is generally realized by having skilled professionals carry out these tasks in small batches.

In robot-supported grinding devices a grinding tool (e.g. an orbital grinding machine) is guided by a manipulator, for example, an industrial robot. In the process, the grinding tool may be coupled to the so-called tool center point (TCP) of the manipulator in various ways that enable the manipulator to adjust the tool to virtually any position and orientation. Industrial robots are generally position-controlled, which makes it possible to move the TCP precisely along the desired trajectory. In order to achieve good results from robot-support grinding, in many applications the processing force (grinding force) must be regulated, which is often difficult to realize with sufficient accuracy using conventional industrial robots. The moment of inertia of the large and heavy arm segments of an industrial robot is too large for a closed-loop controller to be able to react quickly to fluctuations in the processing force. To solve this problem, a linear actuator, smaller than the industrial robot, may be disposed between the TCP of the manipulator and the grinding tool in order to couple the TCP of the manipulator to the grinding tool. In this case the linear actuator only controls the processing force (that is, the application force between the tool and the workpiece), while the manipulator moves the grinding tool, together with the linear actuator, along the specifiable trajectory in a position-controlled manner.

Grinding machines such as, e.g. eccentric grinders, operate using thin, flexible and removable grinding discs which are attached to a backing pad. One very commonly used type of backing pads are the so-called daisy discs. A grinding disc is typically made of paper (or of a different fiber composite material) which is coated with abrasive particles and it can be attached to the carrier plate, e.g. by means of an adhesive layer, a hook and loop fastener or a Velcro fastener. Worn grinding discs are frequently changed manually, even in robot-supported grinding devices. Although a few concepts for robot-supported changing stations for changing grinding discs do exist, the known solutions are in general very complex and their realization is time-consuming and expensive.

The inventors identified a need for a changing station which makes it possible for a robot-supported grinding device to automatically change grinding discs in a relatively easy manner.

SUMMARY

An apparatus for automatically removing a grinding disc from a grinding machine mounted on a manipulator is described herein. In accordance with one embodiment, the apparatus comprises the following; a bearing plate with a surface on which a grinding disc can be placed; a moveable clamping element which, in a first position, is elevated above the bearing plate; an actuator which is coupled to the clamping element and which is configured to move the clamping element into a second position in which the clamping element is pressed against the bearing plate such that the grinding disc is clamped in place between the bearing plate and the clamping element; and a release element which is arranged relative to the bearing plate such that the release element is actuated when the grinding disc is placed onto the surface of the bearing plate and is pressed against it. The release element and the actuator are (directly or indirectly, electrically or mechanically) coupled to each other such that, when the release element is actuated, the actuator moves the clamping element from the first position into the second position.

Further, a method for the automatic removal of a grinding disc from a grinding machine mounted on a manipulator is described herein. In accordance with one embodiment, the method comprises the following: Placing a grinding disc that is mounted on a grinding machine onto a bearing plate of a removal device by means of a manipulator, wherein, by placing the grinding disc onto the bearing plate, a release element of the removal apparatus is actuated. The method further comprises clamping the grinding disc in place between the bearing plate and a moveable clamping element which, in reaction to the actuation of the release element, is pushed into the direction of the bearing plate, and raising the grinding machine by means of the manipulator, by means of which the clamped grinding disc is removed from a carrier plate of the grinding disc.

BRIEF DESCRIPTION OF THE DRAWINGS

In the following, various embodiments will be described in detail with reference to the illustrations in the figures. The illustrations are not necessarily true to scale and the embodiments described below are not limited to the aspects illustrated herein. Instead, importance is given to illustrating the basic underlying principles of the illustrated embodiments.

DETAILED DESCRIPTION

Figure 1:
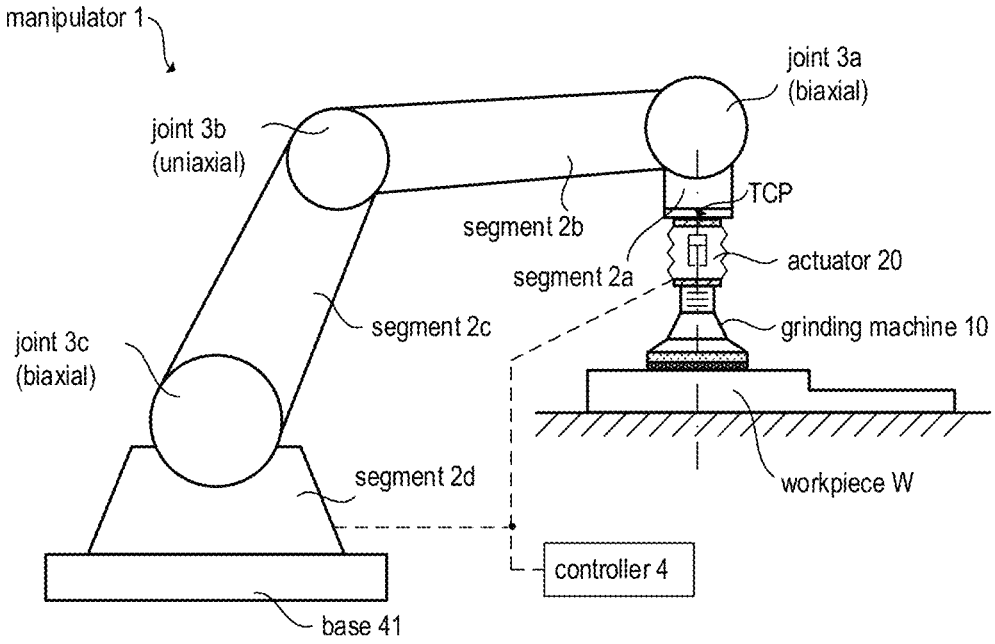
FIG. 1 schematically illustrates an example of a robot-supported grinding apparatus.

Before explaining various embodiments in detail, first a general example of a robot-supported grinding apparatus will be described. The example encompasses a manipulator 1, for example an industrial robot, and a grinding machine 10 with a rotating grinding tool (e.g. an orbital grinding machine), wherein the latter is coupled to the tool center point (TCP) of the manipulator 1 via a linear actuator 20. In the case of an industrial robot possessing six degrees of freedom, the manipulator may be constructed of 4 segments; 2*a*, 2*b*, 2*c* and 2*d*, each of which is connected via joints 3*a*, 3*b* and 3*c* (the first segment is usually rigidly attached to a base 41, which, however, need not necessarily be the case). Joint 3*c* connects the segments 2*c* and 2*d*. Joint 3*c* may be biaxial and allow a rotation of segment 2*c* around a horizontal axis of rotation (elevation angle) and around a vertical axis of rotation (Azimuth angle). Joint 3*b* connects the segment 2*b* and 2*c* and allows a swivel movement of segment 2*b* relative to the position of segment 2*c*. Joint 3*a* connects the segments 2*a* and 2*b*. Joint 3*a* may be biaxial and may (as in the case of joint 3*c*) allow a swivel movement in two directions. The TCP is at a permanent relative position in respect to segment 2*a*, wherein the latter usually also encompasses a rotational joint (not shown) which allows a rotational movement around a longitudinal axis of segment 2*a* (designated in FIG. 1 using a dot-dashed line and which corresponds to the axis of rotation of the grinding tool). An actuator is assigned to every axis of a joint in order to effect a rotational movement around the respective joint axis. The actuators in the joints are controlled by a robot controller 4 in accordance with a robot program.

The manipulator 1 is usually position-controlled, i.e. the robot controller can determine the pose (position and orientation) of the TCP and can move it along a previously defined trajectory. When the actuator 20 comes to rest against an end stop, the pose of the TCP also defines the pose of the grinding tool. As previously mentioned, the actuator 20 serves to adjust the contact force (processing force) between the tool (grinding machine 10) and the workpiece 40 to a desired value during the grinding process. Controlling the force directly using the manipulator 1 is generally too inaccurate for grinding applications because the large moment of inertia of segments 2*a*-2*c* of the manipulator 1 renders it virtually impossible for conventional manipulators to quickly compensate force peaks (e.g. such as occurs when the grinding tool is placed on the workpiece 40). For this reason the robot controller is configured to adjust the pose of the TCP of the manipulator, while the force adjustment is carried out exclusively by the actuator 20.

As previously mentioned, during the grinding process the contact force FK between the tool (grinding machine 10) and the workpiece 40 can be adjusted with the aid of the (linear) actuator 20 and a force controller (which, for example, may be implemented in the controller 4) such that the contact force between the grinding tool and the workpiece corresponds to a specifiable target value. The contact force is in this case a reaction to the actuator force with which the linear actuator 20 presses against the surface of the workpiece. If contact between the workpiece 40 and the tool is absent, the actuator 20 comes to rest, due to the lack of contact force on the workpiece 40, against an end stop. The position control of the manipulator 1 (which may also be implemented in the controller 4) can operate completely independently of the force control of the actuator 20. The actuator 20 is not responsible for positioning the grinding machine 10, but instead only for the adjustment and maintenance of the desired contact force during the grinding process and for detecting a contact between the tool and the workpiece. The actuator may be a pneumatic actuator, e.g. a double-acting pneumatic cylinder. Other pneumatic actuators, however, may also be employed such as, e.g. bellows cylinders and air muscles. Direct electric drives (without transmissions) may also be taken into consideration.

If a pneumatic actuator is employed, the force can be adjusted in a conventionally known manner using a control valve, a controller (implemented in controller 4) and a compressed air reservoir. The specific implementation, however, is of little relevance for the remaining discussion and will therefore not be described here in further detail. As an alternative to the actuator 20 and depending on the application, a passive yielding element such as, e.g. a spring, may also be used. The actuator 20 may also be omitted if the manipulator itself is capable of providing force regulation of a satisfying quality.

Figure 2:
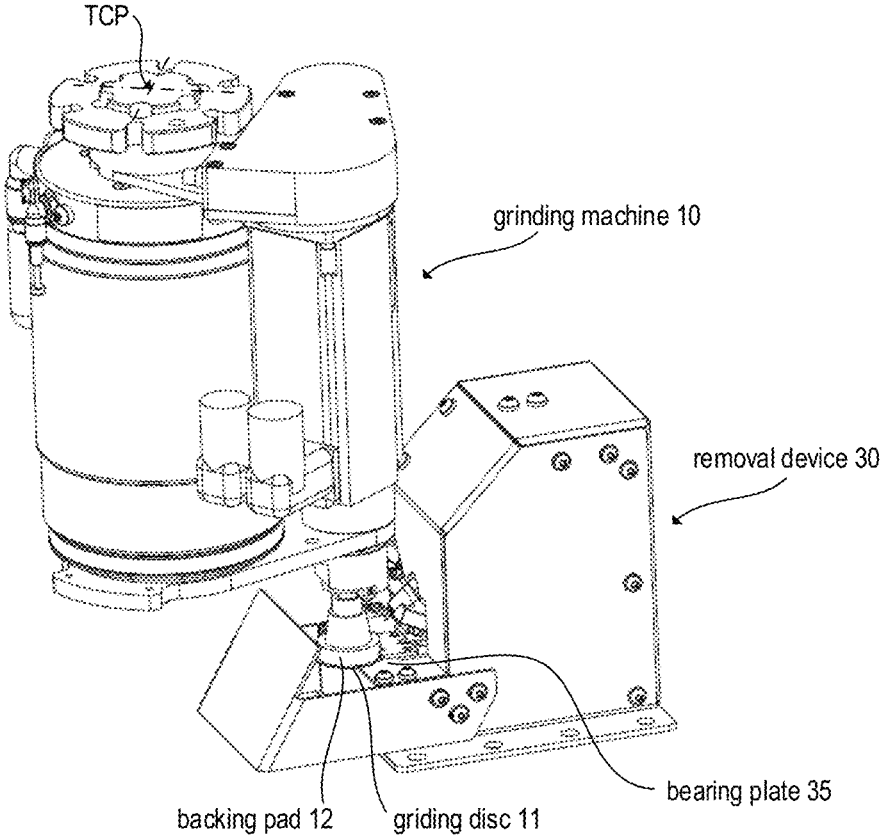
FIG. 2 illustrates a grinding machine mounted on a robot during the automatic removal of a grinding disc by means of a removal device.

The grinding machine 10 comprises a grinding disc 11 which is mounted on a backing pad 12. The surface of the backing pad 12 or the back surface of the grinding disc 11, or both surfaces, are configured such that the grinding disc 11 easily adheres to the backing pad 12 upon contact. For example, a hook and loop fastener or a Velcro fastener may be used to ensure that the grinding disc 11 remains adhered to the backing pad 12. One commonly used alternative to a hook and loop fastener is an adhesive coating on the backside of the grinding disc 11 which adheres to a corresponding surface of the backing pad 12. FIG. 2 illustrates an example of a grinding apparatus 10 which can be mounted on a manipulator and in which the grinding machine 10 is positioned relative to a grinding disc removal device 30 such that the grinding disc 11 rests against the surface of a bearing plate 35 of the grinding disc removal device 30 and is pressed against this bearing plate 35 (e.g. with an adjustable force). In the following, one embodiment of the grinding disc removal device 30 will now be described in detail with reference to the FIGS. 3 to 6.

Figure 3:
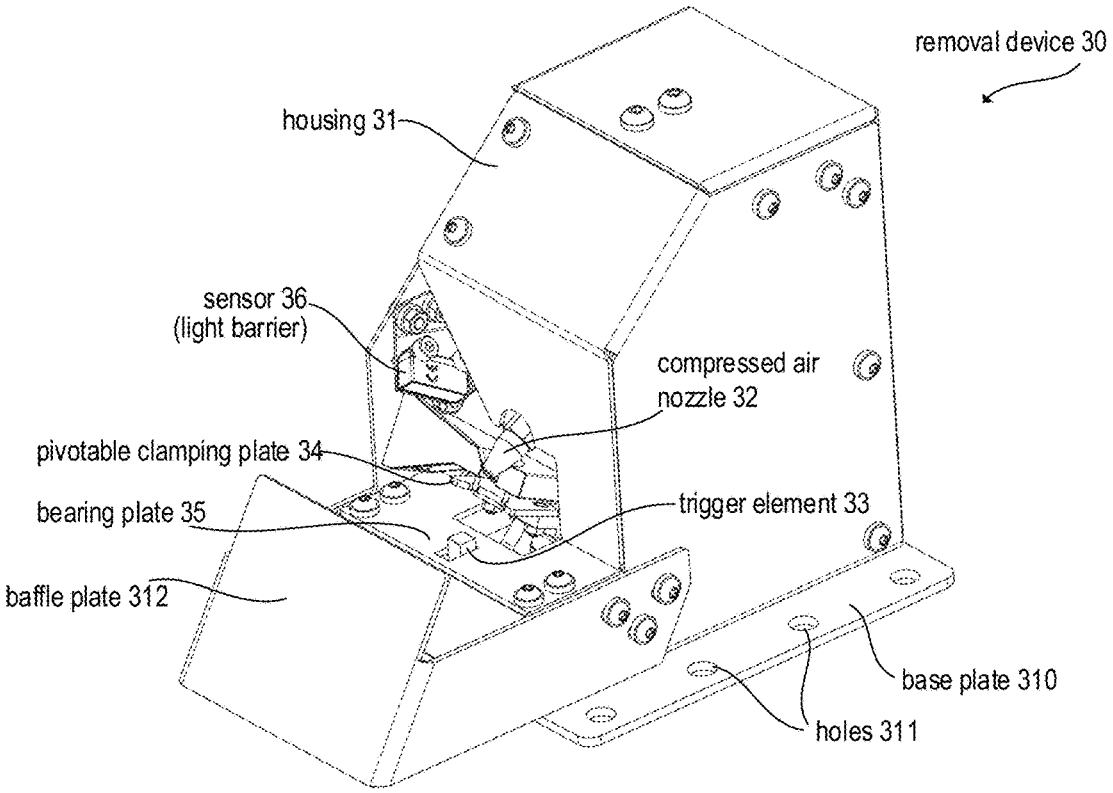
FIG. 3 illustrates an example of a removal device which is suited for the automatic removal of grinding discs from a grinding machine mounted on a robot.
Figure 4:
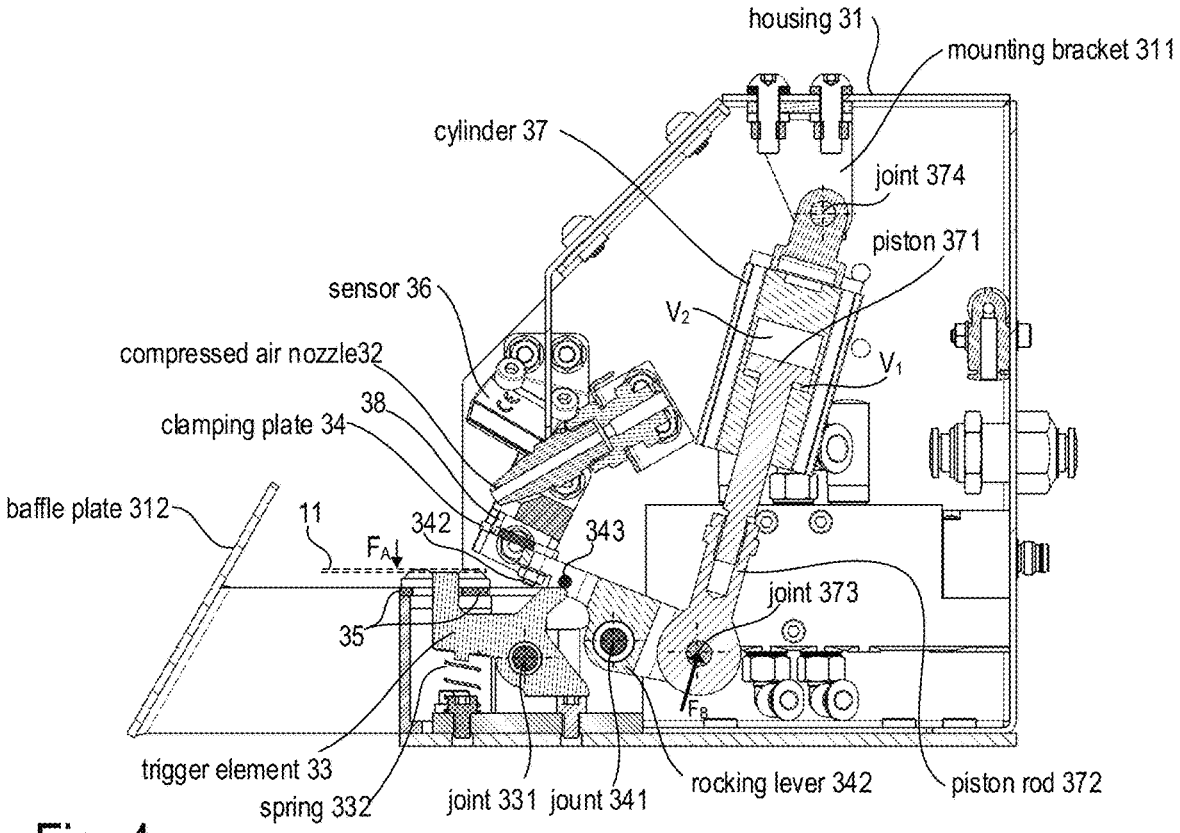
FIG. 4 is a sectional view of the removal device from FIG. 3 showing the inside of the removal device in greater detail.

FIG. 3 is a perspective view of the grinding disc removal device 30 from FIG. 2. FIG. 4 is a corresponding sectional view which shows the components located on the inside of the housing 31 of the removal device 30. It should be understood that the housing 31 of the removal device 30 need not necessarily be a closed housing. On the contrary, housing should be understood to designate any mechanical structure on which other components of the removal device 30 can, directly or indirectly, moveably or immovably, be mounted. The housing may comprise a frame to which (in the case of an at least partially closed housing) one or more covers are attached. In the examples illustrated here, the housing 31 comprises numerous parts which are connected by means of screws. It is to be understood, however, that other connection techniques such as, e.g. rivets, snap-in connections, etc. may be employed as well. Depending on the application, the shape of the housing may also be designed in a different fashion than the embodiments described here. In the example shown here, the housing comprises a base plate 310 with holes 311. The base plate 310 (and with it the entire device 30) can be mounted onto the floor or another supporting surface by means of screws (not shown) which are inserted through the holes 311.

As can be seen in FIG. 3, the bearing plate 35, against which the robot presses the grinding disc 11 mounted on the grinding machine 10 during a removal step, comprises an opening through which the end of a trigger element 33 has been inserted. The end of the trigger element 33 protrudes from the opening in the bearing plate 35 such that the protruding end of the trigger element 33 is pushed into the opening (see FIG. 4, application force $F_A$) when the grinding disc 11 is pressed against the bearing plate 35 and comes to lie flatly on it during a removal process. The opening can also be implemented as a slit. It should be understood that the end of the trigger element 33 need not necessarily run through an opening in the bearing plate 35. Alternatively, the trigger element 33 may be arranged next to the bearing plate. It is only important that the trigger element 33 be arranged such that it is actuated when the robot presses the grinding disc 11 against the surface of the bearing plate 35.

The actuation of the trigger element 33 (when the grinding disc is pressed against the bearing plate 35) triggers a mechanism that results in the edge of the grinding disc 11 being clamped in between the bearing plate 35 and a clamping plate 34. When the robot again moves the grinding machine 11 away from the removal device 30, the grinding disc 11 is held in place by the clamping plate 34, while the backing pad 12 of the grinding machine 10 is lifted away from the surface of the bearing plate 35. By raising the backing pad 12, the (clamped) grinding disc 11 is removed from the backing pad 12. In the following, an example of this described mechanism will be described in detail with reference to FIGS. 4 and 5.

As is illustrated in FIG. 4, the clamping plate 34 (generally referred to here as clamping element) is mounted on a first end of a rocking lever 342 which is rotatably mounted on a part of the housing 31 by means of a joint 341. This means that the rocking lever 342, which may also be called a rocker, can be swiveled around a pivot point (which is defined by the joint 341). The clamping plate 34 (clamping element) may be attached to the rocking lever 342, e.g. by means of one or more screws. In other embodiments the clamping plate 34 and the rocking lever 342 may be constructed in one piece. In the situation illustrated in FIG. 4, the rocking lever 342 is positioned (first position) such that the clamping plate 34 is lifted away from the bearing plate 35. In the situation illustrated in FIG. 5, the rocking lever 342 is position (second position) such that the clamping plate 34 is pressed against the surface of the bearing plate 35 and a grinding disc (provided it has been correctly positioned on the bearing plate 35) is clamped in between the clamping plate 34 and the surface of the bearing plate 35.

The movement of the rocking lever 342 from the first position (clamp released) into the second position (clamp tightened) is triggered by the actuation of the trigger element 33. In the example illustrated in FIGS. 4 and 5, the rocking lever 342 comprises an end stop 343 which rests against a corresponding bearing surface of the trigger element 33. Similar to the rocking lever 342, the trigger element 33 is pivotally mounted on a part of the housing 31 (rotational joint 331) and is pressed, by means of a spring 332, into a standard position in which an end of the trigger element 33, as illustrated in FIG. 4, protrudes beyond the surface of the bearing plate 35. In this standard position the trigger element 33 functions as a pawl which prevents movement of the rocking lever 342 into the second position (clamp tightened). When the end stop 343 of the rocking lever 342 comes to rest against the trigger element 33 (functioning here as a pawl), the movement of the rocking lever 342 is blocked. When the protruding trigger element 33 is pushed, contrary to the spring force of the spring 332, towards the surface of the bearing plate 35, the trigger element 33 is swiveled such that the end stop 343 of the rocking lever 342 moves away from the trigger element 33 and a movement of the rocking lever 342 into the second position is no longer blocked.

Figure 5:
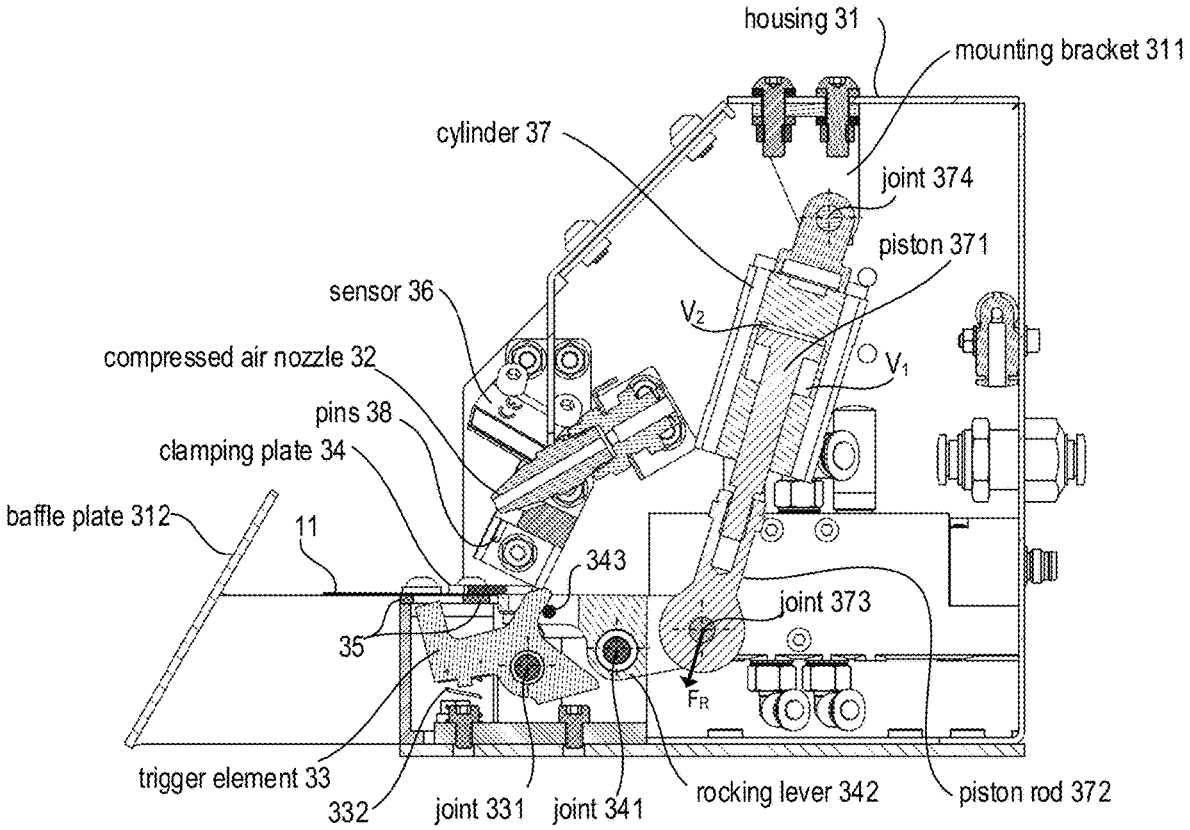
FIG. 5 shows the example from FIG. 4 with a grinding disc clamped in place.

In the example illustrated in FIGS. 4 and 5, when the rocking lever 341 is in the first position (clamp released, the pawl blocks the movement of the rocking lever), a biasing force $F_B$ is exerted onto the rocking lever 341. When the trigger element 33 is actuated/moved, the pawl (release element) releases the rocking lever 341 and the latter abruptly swings, due to the biasing force $F_B$, into the second position in which the grinding disc is clamped in place. This situation is illustrated in FIG. 5.

The aforementioned biasing force $F_B$ can be provided by various biasing mechanisms. In the example from FIGS. 4 and 5 this biasing mechanism comprises a pneumatic cylinder 37 disposed between a second end of the rocking lever 341 and a part (e.g. mounting bracket 311) of the housing 31. The cylinder 37 is connected to the mounting bracket 311 (which can be regarded as a part of the housing) by means of a joint 374 and the piston rod 372 of the piston 371 disposed in the cylinder is connected to the second end of the rocking lever 341 by means of a joint 373. When the cylinder chamber (designated $V_1$ in FIGS. 4 and 5) is filled with compressed air, the pneumatic cylinder 37 generates (with its respective piston 371) the biasing force $F_B$ which pushes, by actuating the trigger element 33, the rocking lever 341 into the second position and clamps the grinding disc in place.

As previously mentioned, after clamping the grinding disc 11, the grinding machine 10 is again moved away from the removal device 30, by means of which the (clamped) grinding disc 11 is pulled off the backing pad 12. After this the rocking lever 341 (and with it the clamping plate 34) have to be moved back from the second position (clamp tightened, FIG. 5) into the first position (clamp released, FIG. 4). This movement can be performed by various kinds of reset mechanisms. In the example illustrated in FIGS. 4 and 5, the reset mechanism is the pneumatic cylinder 37. In this case, the biasing mechanism and the reset mechanism form one unit. The cylinder 37 may be a double-acting cylinder. This means that, when the cylinder chamber (designated V2 in FIGS. 4 and 5) is filled with compressed air, the pneumatic cylinder 37 generates a reset force $F_R$ that acts in the exact opposite direction of the biasing force $F_B$. The reset force $F_R$ effects a swivel movement of the rocking lever 341 back into the first position, by means of which the clamp on the grinding disc is released. The spring 332 pushes the trigger element 33 back into the standard position so that, when the biasing force $F_B$ again takes effect during the next removal process, the movement of the rocking lever 341 will again be blocked (as illustrated in FIG. 4).

Air can be blasted onto the grinding disc 11 at a high velocity through the compressed air nozzle 32, blowing it in the direction of the baffle plate 312 and onwards, e.g. into a container. The compressed air nozzle 32 and the baffle plate 312 are both optional, but in actual practice they can improve the robustness of the device 30. The reset mechanism (e.g. switching the compressed air from cylinder chamber $V_1$ to cylinder chamber $V_2$), as well as the blasting of compressed air out of nozzle 32, can be triggered by the robot controller (see FIG. 1, controller 4), as the robot controller "knows" when the grinding machine 10 has been moved away from the removal device 30. As an alternative, the reset mechanism can also be triggered by the trigger element 33 swiveling back into the standard position. For this purpose, an electric switch could be coupled to the trigger element 33 and actuating the electric switch can trigger the switching of the compressed air from cylinder chamber $V_1$ to cylinder chamber $V_2$, as well as the blasting of compressed air from nozzle 32. A corresponding nozzle controller with its respective nozzles is not illustrated in the figures as various possibilities for implementing the nozzle control fall within the scope of the skilled person's professional capabilities.

Some grinding discs stay adhered to the backing pad 12 (see FIG. 2) by means of an adhesive layer. In such cases it may occur that the grinding disc remains adhered to the clamping plate 34. In order to be able to reliably remove the grinding disc from the device 30 (e.g. by blasting compressed air out of the nozzle 32), one or more pins 38 may be (directly or indirectly) attached to the housing 31 which are arranged such that a grinding disc 11 that remains adhered to the clamping plate 34 is pushed away from the clamping plate 34 when the latter is moved back into the first position. The pins 38 are shown in FIGS. 4 and 5. In the overhead view from FIG. 6, which corresponds to FIG. 5, one can see that the clamping plate 34 possesses small recesses 38', through which the pins 38 are forced when the clamping plate 34 is moved (away from the bearing plate 35) into the first position. If a grinding disc remains adhered to the clamping plate 34 when this movement is carried out, it will be pushed away by the pins 38 when the movement is completed and thereby released from the clamping plate 34, and the grinding disc is then transported away by the compressed air.

Figure 6:
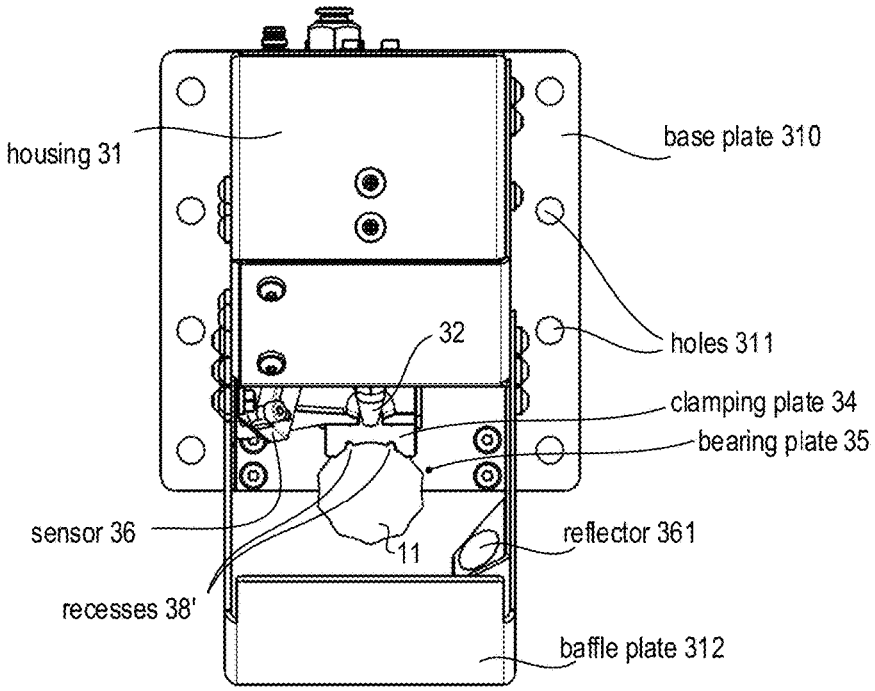
FIG. 6 is a corresponding overhead view of the example from FIG. 5.

In order to verify whether the grinding disc removed from the grinding machine 10 has actually been transported away from the removal device 30, the removal device 30 may comprise a sensor 36. The sensor 36 can be seen in FIGS. 4-6 and may be implemented, for example, as reflex light barrier. In FIG. 6 the corresponding reflector 361 of the reflex light barrier 36 is also shown. The sensor 36 (e.g. a module with a light emitting diode and a photodiode) and the reflector 361 are positioned relative to each other such that the light beam emitted from the sensor 36 is interrupted by a grinding disc. In this way the sensor can detect whether or not the grinding disc has been transported away by the compressed air. If it has not been, one or more additional blasts of compressed air can be emitted from the nozzle 32. If the grinding disc then still remains adhered to the removal device, a warning signal, for example, might be triggered. The sensor 36 need not necessarily be implemented as a light barrier. Since the grinding discs are usually of a certain color, instead an optical color sensor may also be employed to detect the presence of a grinding disc. Alternatively, one or more sensors may be employed to monitor whether the grinding disc falls out of the device 30 from underneath the baffle plate 312.

It should be understood that the function of clamping the grinding disc 11 between the bearing plate 35 and the clamping element 34 (clamping plate) and of the trigger element 33 releasing the movement of the clamping element can be realized in other ways than as those illustrated in the example from FIGS. 2-6. In the following, a few important aspects of the removal device 30 will be summarized and further embodiments will be discussed in which certain functions are implemented differently than in the example from FIGS. 2-6.

In general terms, the removal device comprises a bearing plate (see, e.g. FIGS. 2 and 6, bearing plate 35) which has a surface on which a grinding disc 11 can be placed. As shown in FIG. 2, the grinding disc 11 can be placed onto the surface of the bearing plate 35 with the aid of a robot. As one can see, for example, in FIG. 6, the entire grinding disc 11 need not be placed onto the surface of the bearing plate 35. It suffices if a part of the grinding disc rests on the bearing plate 35. The removal device further comprises a moveable clamping element (see, e.g. FIGS. 4 and 5, clamping element 34) which, in a first position, is raised above the bearing plate. This means that, in the first position, the clamping element does not come into contact with the bearing surface. The removal device further comprises an actuator, which is coupled to the clamping element, and which is configured to move the clamping element into a second position in which the clamping element is pressed against the bearing plate such that the grinding disc is clamped in place in between the bearing plate and the clamping element (see FIG. 5). A trigger element is coupled (directly or indirectly and, depending on the actuator, mechanically or electrically) to the actuator such that, when the trigger element is actuated, the actuator moves the clamping element from the first position into the second position. The trigger element protrudes beyond the surface of the bearing plate such that the trigger element is actuated when the grinding disc (mounted on the grinding machine) is positioned on the surface of the bearing plate and is pressed onto it.

In the simplest of cases, the actuator may be a biased spring. A pneumatic actuator (pneumatic cylinder-piston unit) can also fulfill the same function as a biased spring when it is filled with compressed air. In some embodiments, the clamping element blocks, until it is actuated, the movement of the actuator (see FIG. 4, cylinder preloaded with compressed air), which then abruptly moves the clamping element from the first position (clamp released) into the second position (clamp tightened) when the trigger element is actuated (see FIG. 5). In this case, the trigger element is a purely mechanical machine element that essentially fulfills the function of a pawl. In order to move the clamping element back into the first position, a reset mechanism may be provided. If a double-acting pneumatic cylinder is used as an actuator, it can generate enough reset force to move the clamping element back into the first position. If a single-acting pneumatic cylinder is used, a spring can also generate the needed reset force to move the clamping element back into the first position when the pressure is released from the single-acting pneumatic cylinder. In the aforementioned example, in which the actuator is a simple biased spring, the reset force can be generated, for example, by a solenoid which is capable of re-biasing the spring. Possible is also a unit consisting of two (single-acting) pneumatic cylinders, whereby one cylinder serves as a (biased) actuator and the other is responsible for the resetting movement into the first position.

In other embodiments the actuator does not need to generate a biasing force while the movement of the actuator is mechanically blocked by the trigger element. Instead, the actuator is actively controlled to move the clamping element from the first position into the second position when the trigger element is actuated which, in this case, may also be an electric switch (e.g. a probe), which in turn is positioned such that it protrudes beyond the bearing plate and is thereby "automatically" actuated when the grinding disc mounted on the grinding machine is placed onto the surface of the bearing plate. In this case the actuator may be any given actuator (an electromotor, a linear motor, a pneumatic actuator, a solenoid, etc.) which is configured to move the clamping element from the first position into the second position. Instead of a simple switch like, e.g. a probe, a different sensor element may also be used which is capable of detecting that a grinding disc has been placed on the bearing plate.

In the embodiments described here, the clamping element is mounted on an end of a rocking lever (see FIG. 5). It should be understood, however, that the clamping element and the rocking lever may also be one integrated component. In such a case, the clamping element and the rocking lever are constructed in one piece. The clamping element can be implemented as a small slide, referred to above as clamping plate. However, the clamping element need not necessarily be a slide but instead may be formed, for example, of numerous short pins that protrude from the rocking lever and which can clamp the grinding disc to the bearing plate.

Figure 7:
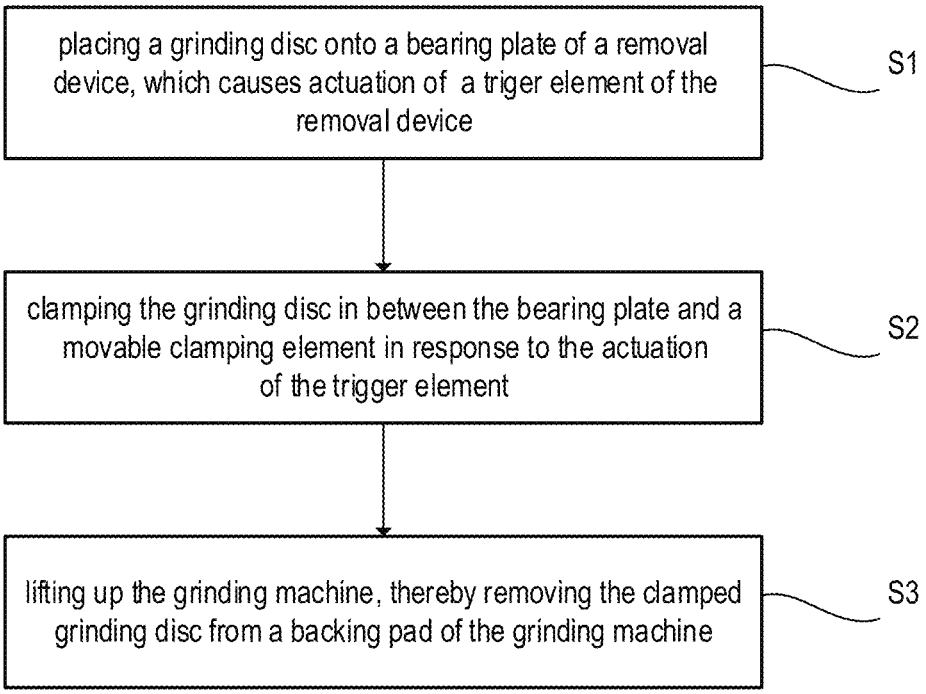
FIG. 7 is a flow chart illustrating an example of a method for the robot-supported, automatic removal of a grinding disc from a grinding machine.

In the following an example of a method for the removal of a grinding disc from a grinding machine mounted on a manipulator will be summarized with reference to the flow chart shown in FIG. 7. In accordance with the embodiment of FIG. 7, the method comprises placing a grinding disc mounted on a grinding machine onto a bearing plate of a removal device by means of a manipulator (cf. FIG. 7, step S1). This situation is also illustrated in FIG. 4. By placing the grinding disc onto the bearing plate, a trigger element of the removal device is also actuated (cf. FIG. 4, trigger element implemented as pawl). The method further comprises clamping the grinding disc in between the bearing plate and a moveable clamping element (FIG. 7, step S2), which is pushed towards the bearing plate in reaction to the actuation of the trigger element. This situation is also illustrated in FIG. 5. Following this, the grinding machine is lifted up with the aid of the manipulator, whereby the clamped grinding disc is pulled off a backing pad of the grinding machine (cf. FIG. 7, step S3).

Following this, the clamping element can once again be raised in order to release the clamped grinding disc. In the process it may happen, as described earlier, that the grinding disc remains adhered to the clamping element, which is undesirable, as it hampers the further transport of the grinding disc. In such cases, the grinding disc can be released using one or more pins (see FIG. 5, pins 38). The pins 38 block the movement of the grinding disc adhered to the clamping element when the clamping element is raised, whereby the grinding disc is released from the clamping element. The pin or pins may be mounted in the housing of the removal device such that the pins penetrate one or more recesses (see FIG. 6, recesses 38') on the edge of the clamping element when the clamping element is raised. Various further aspects of the method have already been described above with reference to FIGS. 2-6 and, in order to avoid repetition, reference is made to the above description.

Terms such as "first", "second", and the like, are used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

It is to be understood that the features of the various embodiments described herein may be combined with each other, unless specifically noted otherwise.

Although various embodiments have been illustrated and described with respect to one or more specific implementations, alterations and/or modifications may be made to the illustrated examples without departing from the spirit and scope of the appended claims. With particular regard to the various functions performed by the above described components or structures (units, assemblies, devices, circuits, systems, etc.), the terms (including a reference to a "means") used to describe such components are intended to correspond—unless otherwise indicated—to any component or structure that performs the specified function of the described component (e.g., that is functionally equivalent), even if it is not structurally equivalent to the disclosed structure that performs the function in the herein illustrated exemplary implementations of the invention.

It will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. An apparatus, comprising:

a plate with a surface for depositing a grinding disc;

a moveable clamping element which, in a first position, is raised in relation to the plate;

an actuator coupled to the moveable clamping element and configured to move the moveable clamping element into a second position in which the moveable clamping element is pressed against the plate such that the grinding disc is clamped in between the plate and the moveable clamping element; and a trigger element arranged relative to the plate such that the trigger element is actuated when the grinding disc is placed onto the surface of the plate and is pressed against the plate, wherein the trigger element and the actuator are coupled such that, when the trigger element is actuated, the actuator moves the moveable clamping element from the first position into the second position.

2. The apparatus of claim 1, wherein the trigger element is arranged relative to the plate such that the trigger element is actuated by the grinding disc being pressed against the surface of the plate.

3. The apparatus of claim 1, wherein the trigger element protrudes beyond the surface of the plate such that the grinding disc, when placed onto the surface of the plate and pressed against the plate, actuates the trigger element.

4. The apparatus of claim 1, wherein the actuator is a biased spring or a biased pneumatic or electric actuator, and wherein the trigger element is configured to block a movement of the actuator and, when the trigger element is actuated, to release the movement of the actuator.

5. The apparatus of claim 1, wherein the moveable clamping element is mounted on a rocking lever or on a part of the rocking lever.

6. The apparatus of claim 5, wherein the actuator is coupled to the rocking lever, and wherein the rocking lever couples the actuator and the moveable clamping element.

7. The apparatus of claim 5, wherein the actuator is a double-acting pneumatic cylinder configured to swivel the rocking lever back and forth, such that the moveable clamping element is moved into the second position and back again into the first position.

8. The apparatus of claim 1, further comprising:

one or more pins arranged such that, when the moveable clamping element is moved into the first position, the grinding disc adhered to the moveable clamping element is released.

9. The apparatus of claim 1, further comprising:

a compressed air nozzle configured to emit blasts of air in the direction of the grinding disc.

* * * * *